United States Patent [19]

Stahlecker et al.

[11] 4,069,655

[45] Jan. 24, 1978

[54] OPEN END SPINNING ASSEMBLY WITH AN OPENER ROLL

[76] Inventors: Fritz Stahlecker, Josef-Neidhart-Str. 18, D-7341 Bad Uberkingen; Hans Stahlecker, Haldenstrasse 20, D-7334 Sussen, both of Germany

[21] Appl. No.: 739,035

[22] Filed: Nov. 5, 1976

[30] Foreign Application Priority Data

Dec. 5, 1975 Germany ..... 2554716

[51] Int. Cl.[2] ..... D01H 1/12; D01H 7/00; D01H 13/26

[52] U.S. Cl. ..... 57/58.91

[58] Field of Search ..... 57/58.91, 58.95, 58.89

[56] References Cited

U.S. PATENT DOCUMENTS

| | | | |
|---|---|---|---|
| 3,511,045 | 5/1970 | Bures et al. | 57/58.91 |
| 3,695,021 | 10/1972 | Ormerod et al. | 57/58.91 |
| 3,756,007 | 9/1973 | Bartling | 57/58.91 |
| 3,884,027 | 5/1975 | Schumann et al. | 57/58.95 X |
| 3,990,225 | 11/1976 | Hortlik et al. | 57/58.95 |

*Primary Examiner*—Donald Watkins
*Attorney, Agent, or Firm*—Craig & Antonelli

[57] ABSTRACT

Open-end spinning assembly apparatus including an opener roll disposed in and rotatably supported in a bearing carried by an opener roll housing, with the opener roll and roll housing being constructed together as a detachable structural unit so as to accommodate simple exchange of the opener roll and bearing assembly. In preferred embodiments, the opener roll housing is thrust onto a support shaft and held in position by means of a spring supported and carried by a cover plate for the spinning assembly. A supplementary spring is provided for rotatably biasing the opener roll housing toward a position away from driving engagement with a tangential belt whenever said cover plate for the spinning assembly is opened or removed.

20 Claims, 5 Drawing Figures

FIG. 2
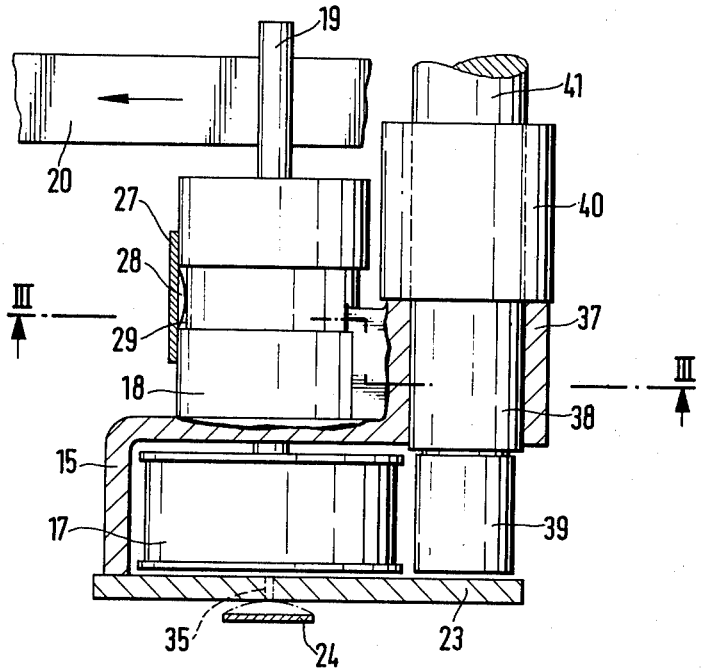
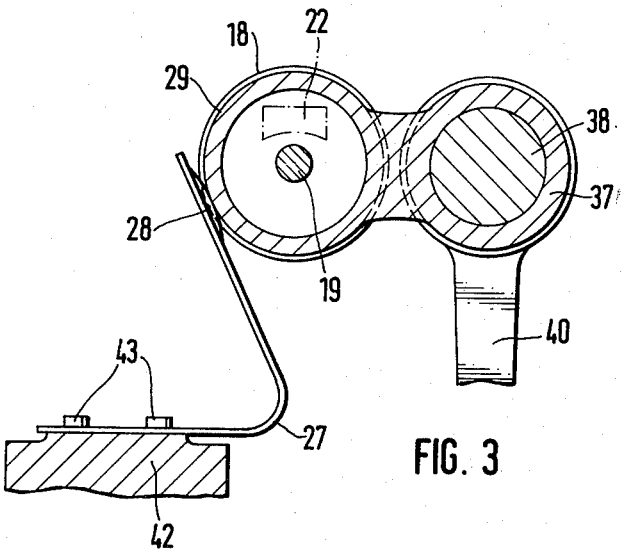
FIG. 3

1
2
4
10
36
11
13
12
7
16
15
35
14
19
29
17
23
27
28
18
24
26
9
8
25
35

23
15
18
27
17

OPEN END SPINNING ASSEMBLY WITH AN OPENER ROLL

BACKGROUND AND SUMMARY OF THE INVENTION

The present invention relates to an opener roll and bearing structure with an opener roll housing arrangement for spinning assemblies. Preferred embodiments of the invention relate to such an arrangement for open end spinning assemblies.

In practical spinning operations, it is advantageous if the opener roll of an open end spinning assembly is easily accessible and can be readily disassembled, so that if there is damage to the opener roll or its bearing there will not have to be a lengthy shutdown of the spinning machine. It has been contemplated to provide arrangements with the opener roll fixed detachably in its bearings in a housing. It is also known (German AS No. 2,234,422) that a clamping section may be provided on the housing that surrounds the opener roll, so that the opener roll, drawn off with its bearing after loosening of the clamping section, can thus be disassembled. If care is not taken in disassembling and assembling such an opener roll, there is danger that the bearing will be jammed and damaged, so that after a short operating time there will again be damage to the opener roll.

The problem to which the invention is addressed therefore is development of a spinning assembly of the kind that is mentioned, such that the opener roll may be easily assembled and disassembled without danger in these operations of damage to the opener roll and its bearing. This problem is solved according to an important feature of this invention by providing that the opener roll and the opener roll housing are made as a detachable structural unit.

The disassembly of the opener roll with its housing that accepts the bearing offers no difficulty to the non-specialist. Very importantly, a disassembling and subsequent assembling operation can be effected without damage to the bearing of the opener roll.

In further development of the invention, it is provided that the housing of the opener roll is thrust onto a support shaft and is secured in the operating position with a cover that can be removed, to open the spinning assembly. If in this embodiment of the invention the cover is removed for a servicing operation, to open the spinning assembly, the housing with the opener roll is no longer secured, so that it can be taken off of the support shaft easily. The disassembly can therefore be done without difficulty by workers who have little training.

These and further objects, features and advantages of the present invention will become more obvious from the following description when taken in connection with the accompanying drawings which show, for purposes of illustration only, several embodiments in accordance with the present invention.

BRIEF DESCRIPTION OF THE DRAWINGS

FIG. 2 is a partially cut-away top view of part of the spinning assembly of FIG. 1;

FIG. 3 is a sectional view along line III—III of FIG. 2;

DETAILED DESCRIPTION OF THE DRAWINGS

Figure 1:
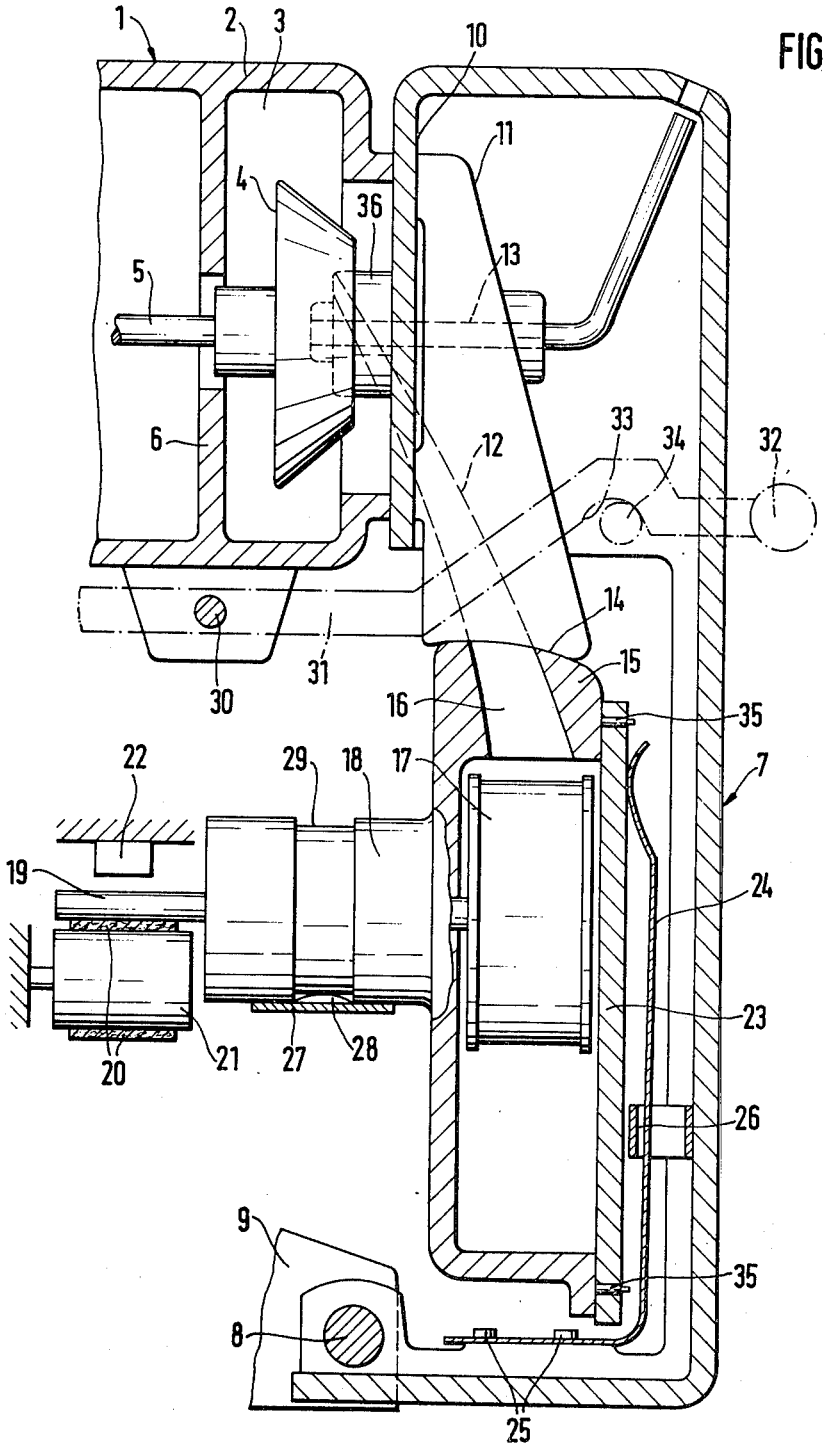
FIG. 1 is a vertical part sectional view through an open end spinning assembly with an opener roll and opener roll housing arrangement constructed in accordance with the present invention.

The open end spinning assembly 1 of FIG. 1 has a housing 2 that includes a vacuum chamber 3 in which a spinning rotor 4 turns. A shaft 5 of spinning rotor 4 extends through a bore in the rear wall 6 of housing 2 and is borne and driven in a way that is not illustrated, since such construction is unnecessary for an understanding of the present invention. Housing 2 is provided with a bore on the front side that is sufficiently large for extraction of spinning rotor 4, which bore in the operational state is closed with a wall 10 of a removable cover plate 7. Said cover plate 7 is pivotable about a shaft 8, which is stationarily disposed on machine frame 9 and extends crosswise with reference to shaft 5. On cover plate 7 there is a so-called guide inset 11 which, in addition to a cylindrical unit 36 extending into spinning rotor 4, presents a fiber delivery passage 12 for fibrous material, as well as a take-off passage 13 for a spun yarn. The fibrous material is supplied in the form of a silver and delivered by a delivery roll 39 that forms a nip with a pressure piece that is not illustrated, to a substantially fast rotating opener roll 17 that separates the fibers. From opener roll 17 that rotates in a housing 15, a passage 16 (in opener roll housing 15) begins somewhat tangentially, going over into fiber delivery passage 12. The whole front side of the open end spinning assembly 1 is covered by cover plate 7. When cover plate 7 is swung down about shaft 8, the guide inset 11 slides on a corresponding surface of housing 15.

Housing 15 for opener roll 17 also forms a bearing housing 18 for a shaft 19 of opener roll 17. Shaft 19 extends beyond the bearing housing 18 and is driven by a tangential belt 20 whose forward and backward running portion is guided by a pressure roll 21. When cover plate 7 is swung down, in a way to be described later, shaft 19 lifts off tangential belt 20 and is braked by a stationary brake 22. Shaft 19 is parallel to shaft 5 of the spinning rotor. Tangential belt 20 runs in the longitudinal direction of the machine and serves to drive several, or all, open end spinning assemblies that are disposed side-by-side in a spinning machine.

Figure 4:
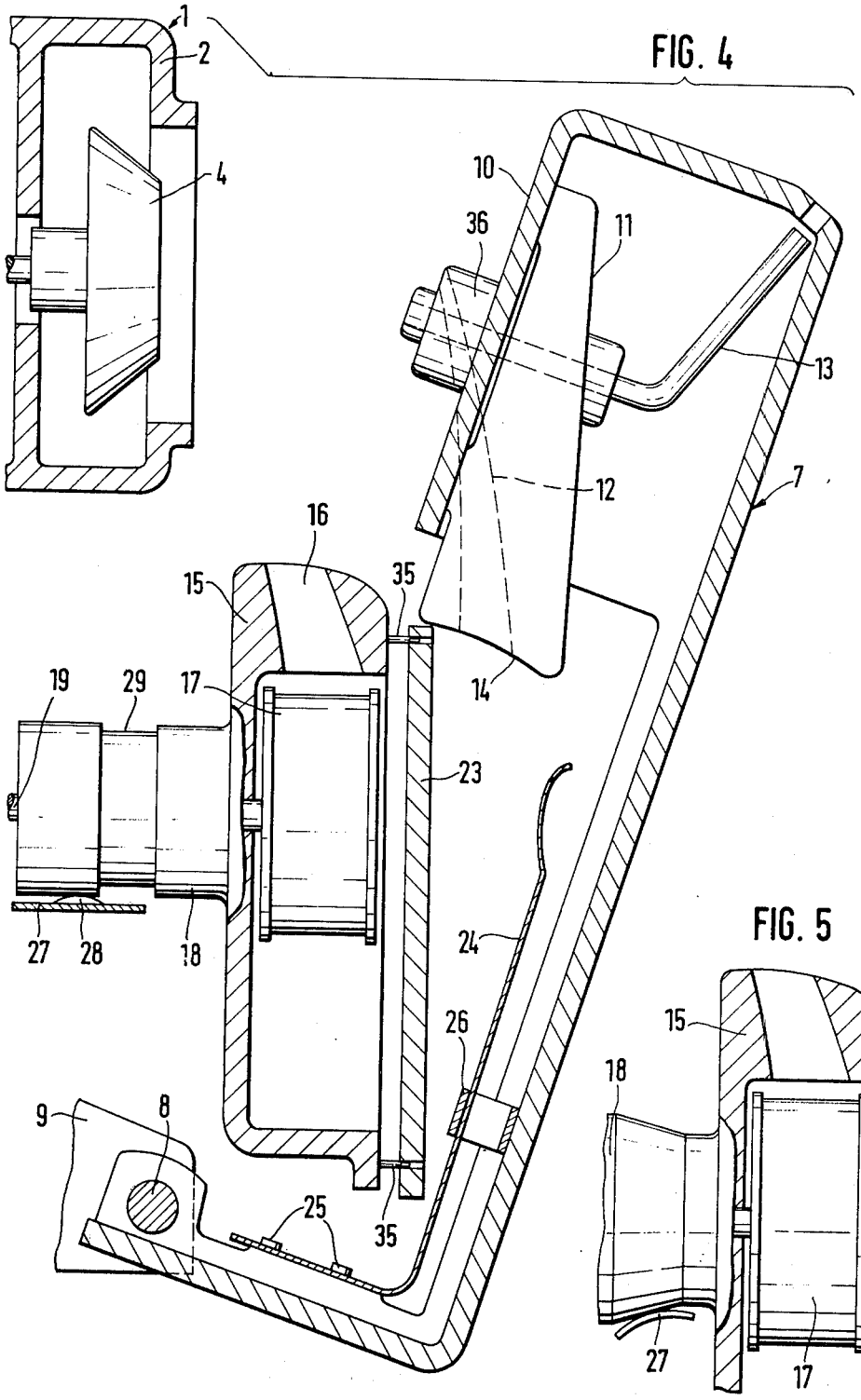
FIG. 4 shows the spinning assembly of FIG. 1 with opened cover.

Housing 15 for opener roll 17 is closed on its open front side by a releasable cover 23 against which a biased holding spring 24 is applied, attached by fastening means 25, e.g. rivets or bolts, to cover plate 7. Said spring 24 on the one hand effects the axial securing of housing 15 when the open end spinning assembly 1 is closed, and on the other hand it effects the securing of cover 23 on housing 15. When cover plate 7 is swung down, spring 24 is carried along, and urged by its pretensioning, it is then applied against a stop 26. This position is shown in FIG. 4; in this position, the axial securing of cover 23 is eliminated, the cover only being held at the sides in guide pins 35, and after swinging of cover plate 7 it can readily be accepted by housing 15.

In FIG. 1 a tightening device is indicated with dot-and-dash lines. For this a swingable lever 31 is provided, that can be swung about a shaft 30 on housing 2. Said lever 31 presents a recess that is applied, when the assembly is closed, to a roll 34 on cover plate 7. When lever 31 is raised by handle 32, recess 33 is disengaged from roll 34, whereby under the effect of biased spring 24 cover plate 7 automatically opens.

FIG. 2 shows that housing 15 is thrust from the front onto a shaft 38 parallel to shaft 19 of opener roll 17, on which shaft 38 it is pivotably borne. Shaft 38 is the drive shaft for delivery roll 39. Housing 15 has a bearing part 37 that is swingably borne on shaft 38. Under the effect of the mentioned spring 24 that presses against cover 23 and therewith against housing 15, the bearing part 37 is axially braced against a stationary structural part 40, in which the axle, or better expressed the shaft 41 of delivery roll 39 is borne. After removal of cover plate 7 (see especially FIG. 4 in conjunction with FIG. 2) housing 15 can be drawn froward from shaft 38, because delivery roll 39 has a somewhat smaller diameter than shaft 38 in the zone with which it accepts bearing part 37 of housing 15.

As to FIG. 3, this particularly shows a supplementary spring 27 that is provided on a machine frame 42, with attaching means 43. Said spring 27 presses against bearing housing 18 for opener roll 17 and urges housing 15 to swing it about shaft 38 (see in this connection FIGS. 1 and 2 also). When cover plate 7 is closed, spring 27 has the effect that housing 15, which is swingable about shaft 38, will be applied with its surface 14 against guide inset 11 of cover plate 7, whereby there will be positioning for operation. Surface 14 here in precisely adapted to a guide surface associated with it, on guide inset 11. With swinging of cover plate 7 about shaft 8, spring 27 effects a slight upward swinging of housing 15 about shaft 38, until shaft 19 of opener roll 17 is applied against a stationary brake lining 22. Shaft 19 hereby lifts off tangential belt 20. Spring 27 assumes still another function, namely an axial securing of housing 15 on shaft 38 if cover plate 7 is swung. For this purpose spring 27 presents a tip 28 that is engaged in a groove 29 of bearing housing 18 (see particularly FIG. 1). After the swinging of cover plate 7, spring 27 can be somewhat depressed as housing 15 is drawn off, so that tip 28 is lifted from groove 29 of bearing housing 18 (see FIG. 4). In this way it is ensured that after the swinging down of cover plate 7, housing 15 will not be abnormally shifted, without however any effect on the ready disassembling of housing 15. This additional security is also an advantage if after swinging off cover plate 7 only cover 23 of the housing is to be opened.

Figure 5:
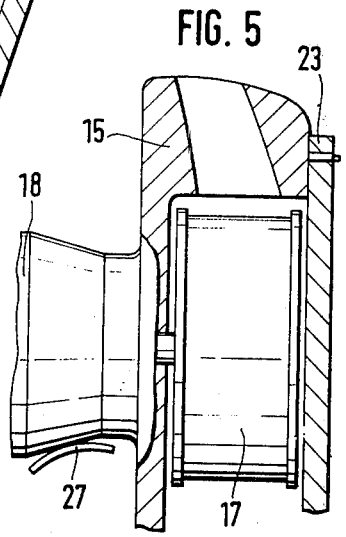
FIG. 5 is a partial sectional view through another embodiment of a spinning assembly arrangement constructed according to the invention.

As the modified embodiment of FIG. 5 shows, a slanted surface is provided on bearing housing 18, against which surface the correspondingly turned spring 27 is applied. In this way there is also a supplementary axial security for housing 15, which does not prevent a drawing off of housing 15 toward the front, because spring 27 can easily be lifted off.

In contrast to the illustrated embodiments, it is also contemplated to arrange opener roll 17 immovably with its housing 15 on the machine frame or on a retaining device on housing 2. In this case advantageously guides are provided, ensuring that housing 15 can be built in only a quite specific position. It is also contemplated to dispose housing 15 that constitutes a structural unit with opener roll 17 detachably on cover plate 7 or on another structural part that can be swung away from spinning rotor 4, and that in addition includes the delivery roll and its appurtenant pressure piece.

While we have shown and described several embodiments in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

We claim:

1. Spinning assembly apparatus comprising:

an opener roll housing, an opener roll disposed in said housing and being rotatably supported by bearing means at said housing, and detachable connecting means for detachably connecting said opener roll housing and opener roll as a structural unit to other spinning machine structures, wherein said connecting means includes a support shaft and a removable cover plate, said cover plate being configured to cover said spinning chamber, and wherein said cover plate is engageably with said opener roll housing to hold said opener roll housing in an operative position with said support shaft extending into a portion thereof.

2. Apparatus as defined in claim 1, further comprising spinning machine frame means and open end spinning turbine means supported at said frame means in said spinning chamber, wherein said structural unit is detachably connected to said spinning machine frame means, said opener roll being disposed and configured to open fibers to be supplied to said turbine means when in an operational position.

3. Apparatus as defined in claim 2, further comprising a fiber delivery roll disposed upstream of the opener roll in the path of fibers being supplied to said turbine means, wherein said support shaft includes means for directly supporting said fiber delivery roll.

4. Apparatus as defined in claim 1, further comprising axial stop means on said support shaft and holding spring element means, wherein said holding spring element means is engageable with said opener roll housing to resiliently force said opener roll housing against said axial stop means on said support shaft.

5. Apparatus as defined in claim 4, wherein said holding spring element means is pretensioned.

6. Apparatus as defined in claim 4, wherein said opener roll housing includes an opener roll housing cover which covers at least a front side of said opener roll, said opener roll housing cover being disposed opposite the holding spring element means so as to be engageable therewith.

7. Apparatus as defined in claim 6, wherein said holding spring element means is pretensioned.

8. Apparatus as defined in claim 2, wherein an opener roll shaft is provided which is attached to and rotatable with said opener roll, said opener roll shaft extending beyond the opener roll housing, wherein a tangential belt is provided which runs crosswise to the axial extent of said support shaft, said opener roll housing being swingably supported on said support shaft, and wherein supplementary spring element means are provided for resiliently forcing said opener roll housing about said support shaft away from a position where said opener roll shaft is drivingly engaged with said tangential belt.

9. Apparatus as defined in claim 8, wherein said supplementary spring element means includes locking device means for supporting said opener roll housing in the axial direction of said support shaft.

10. Apparatus as defined in claim 8, further comprising axial stop means on said support shaft and holding spring element means, wherein said holding spring element means is engageable with said opener roll housing to resiliently force said opener roll housing against said axial stop means on said support shaft.

11. Apparatus as defined in claim 9, further comprising axial stop means on said support shaft and holding spring element means, wherein said holding spring element means is engageable with said opener roll housing to resiliently force said opener roll housing against said axial stop means on said support shaft.

12. Apparatus as defined in claim 6, wherein an opener roll shaft is provided which is attached to and rotatable with said opener roll, said opener roll shaft extending beyond the opener roll housing, wherein a tangential belt is provided which runs crosswise to the axial extent of said support shaft, said opener roll housing being swingably supported on said support shaft, and wherein supplementary spring element means are provided for resiliently forcing said opener roll housing about said support shaft away from a position where said opener roll shaft is drivingly engaged with said tangential belt.

13. Apparatus as defined in claim 12, wherein said supplementary spring element means includes locking device means for supporting said opener roll housing in the axial direction of said support shaft.

14. Apparatus as defined in claim 6, wherein said opener roll housing cover is detachably removable from said opener roll housing to accommodate removal of said opener roll from said opener roll housing.

15. Apparatus as defined in claim 4, further comprising a fiber delivery roll disposed upstream of the opener roll in the path of fibers being supplied to said turbine means, wherein said support shaft includes means for directly supporting said fiber delivery roll.

16. Apparatus as defined in claim 10, further comprising a fiber delivery roll disposed upstream of the opener roll in the path of fibers being supplied to said turbine means, wherein said support shaft includes means for directly supporting said fiber delivery roll.

17. Apparatus as defined in claim 4, wherein said holding spring element means is carried by and movable with said cover plate.

18. Apparatus as defined in claim 14, wherein said holding spring element means is carried by and movable with said cover plate.

19. Apparatus as defined in claim 12, wherein both of said spring element means are readily manually deflectable to positions out of engagement with said opener roll housing to accommodate simple axial removal of said opener roll housing from said support shaft.

20. Apparatus as defined in claim 14, wherein said opener roll housing cover is secured against lateral movement by guide pins which permit free axial movement of said opener roll housing cover when said holding spring element means is out of engagement therewith.

* * * * *